United States Patent [19]

Barnicol-Öttler et al.

[11] Patent Number: 4,538,022

[45] Date of Patent: Aug. 27, 1985

[54] FLEXIBLE ELECTRIC CABLE

[75] Inventors: Max Barnicol-Öttler; Martin Loczenski, both of Neustadt; Norbert Mieschke, Coburg; Gerhard Ott; Gerhard Przybylski, both of Neustadt; Dietmar Weber, Coburg, all of Fed. Rep. of Germany

[73] Assignee: Siemens Aktiengesellschaft, Munich, Fed. Rep. of Germany

[21] Appl. No.: 451,737

[22] Filed: Dec. 21, 1982

[30] Foreign Application Priority Data

Dec. 21, 1981 [DE] Fed. Rep. of Germany ..... 3151235

[51] Int. Cl.[3] ..... H01B 7/04

[52] U.S. Cl. ..... 174/113 R; 174/113 C; 174/116; 174/120 R; 174/120 AR; 174/131 R

[58] Field of Search ..... 174/113 R, 113 C, 120 R, 174/120 SR, 120 SC, 120 AR, 116, 131 R, 131 A

[56] References Cited

U.S. PATENT DOCUMENTS

| | | | |
|---|---|---|---|
| 1,977,209 | 10/1934 | Sargent | 174/131 A |
| 2,427,198 | 9/1947 | Frisco | 174/120 AR |
| 3,324,233 | 6/1967 | Bryant | 174/113 R |
| 3,485,938 | 12/1969 | Kingsley | 174/120 SR X |
| 3,993,860 | 11/1976 | Snow et al. | 174/116 X |

FOREIGN PATENT DOCUMENTS

| | | | |
|---|---|---|---|
| 448487 | 5/1948 | Canada | 174/120 R |
| 1180813 | 11/1964 | Fed. Rep. of Germany | 174/113 R |
| 1465777 | 10/1969 | Fed. Rep. of Germany | 174/113 R |
| 2419965 | 11/1975 | Fed. Rep. of Germany | 174/120 SC |
| 2504555 | 8/1976 | Fed. Rep. of Germany | 174/113 R |
| 2803464 | 8/1979 | Fed. Rep. of Germany | 174/113 R |
| 565319 | 11/1944 | United Kingdom | 174/120 AR |

*Primary Examiner*—A. T. Grimley
*Assistant Examiner*—Morris H. Nimmo
*Attorney, Agent, or Firm*—Kenyon & Kenyon

[57] ABSTRACT

In order to improve the mechanical strength of power and control cables which are subjected to high mechanical stresses in operation, the conductors are elastically fixed to a structural element of the cable. To this end, the conductor insulation is joined in a material-bonded manner to the structural element which consists of a soft elastomer. The conductors are provided, for instance, with a thin cover layer of polyethylene which can be cross-linked peroxidically and is cross-linked after the inner jacket is applied, and in the process makes a material-bonded connection to the inner jacket which consists of a vulcanizable mixture of ethylene-propylene rubber and natural rubber.

8 Claims, 3 Drawing Figures

FLEXIBLE ELECTRIC CABLE

BACKGROUND OF THE INVENTION

This invention relates to electric power distribution in general and more particularly to flexibly coupling movable consumers such as lifting equipment, transporting and conveyor machinery as well as material handling equipment to a stationary power network, using an electric multiconductor cable.

Flexible electric cables which are used for supplying power to movable consumers and which are wound and unwound continuously onto or off from a drum in the process, are subjected to considerable mechanical stresses. Sometimes, these stresses lead to corkscrew-like distortions of the cable. Basically, the design of such a power or control cable, which usually consists of conductors which are arranged about a core (dummy conductor) in one or two layers and a one or two layer jacket, which is optionally provided with an embedded braid, takes care of the occurring mechanical stresses (DE-AS No. 11 80 813, DE-AS No. 14 65 777, DE-OS No. 28 03 464). Even so, mechanical stresses which result in the above-mentioned distortions can occur due to torsion and tensile stresses placed on the conductors in conjunction with their mobility relative to each other as well as to the jacket.

Starting from an electric flexible multiconductor cable, the conductors of whch are stranded about a core in one or more layers, and are surrounded by a one layer or multilayer plastic or rubber jacket, it is an object of the present invention to modify the mechanical design of the cable so that the occurrence of corkscrew-like distortions is avoided.

SUMMARY OF THE INVENTION

To solve this problem, according to the present invention, each conductor has its surface joined in a material-bonded manner on a point by point basis, along a line or over an area, to a structural element which extends over the entire length of the cable and consists, in the region bordering on the conductors, or as a whole, of a rubber elastic material (elastomer) with a Shore-A hardness of not more than 75.

With such a design of the cable, the conductors are returned to their original place when the cable is load relieved, due to their elastic fixation at a structural element of the cable, i.e., at the core (dummy conductor) and/or an intermediate jacket and/or the jacket or inner jacket. Permanent deformations and dislocations of the conductors are thereby suppressed.

In the new cable, special technical conditions relating to the materials prevail. These are met particularly well by cross-linkable materials such as ethylene-propylene, natural and styrene-butadiene rubber as well as blends of these materials.

The elastic fixation of the conductors to the elastomer structural element can be accomplished, for instance, by arranging a fusion-adhesive foil between each conductor and the rubber-elastic structure element. A suitable fusion adhesive can also be applied, however, by means of a spray gun or by extrusion on the conductors. A more advantageous solution from a production standpoint, which is more effective in achieving its objective in fixing the conductors to the inner jacket where a vulcanizable inner-jacket mixture with an ethylene-propylene rubber base mixed with natural rubber is used, comprises coating each conductor with a thin cover layer of polyethylene which can be cross-linked peroxidically, and cross-linking the coating after the inner jacket is applied. Otherwise, all pertinent plastics and rubber types which can be trimmed by correspondingly suitable additives to a Shore-A hardness of not more than 75, can be considered for the structural elements. These may be thermoplastic elastomers (uncross-linked plastic mixtures or mixed polymers with elastomer characteristics) as well as cross-linked or vulcanized plastic and/or rubber mixtures. Especially suitable are mixtures with an ethylene-propylene copolymerisate or ethylene-propylene terpolymerisate and with a polychloroprene rubber base.

DETAILED DESCRIPTION

Figure 1:
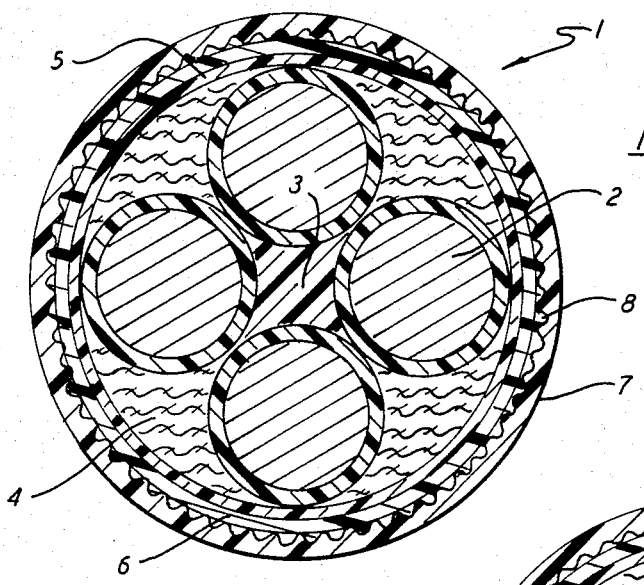
FIG. 1 is a cross-section through one embodiment of a four conductor cable according to the present invention.

FIG. 1 shows a four conductor power cable 1 such as is used, for instance, for ship loading devices. It consists of insulated conductors 2 which are stranded about a core 3 and are surrounded together by a jacket which consists of an inner jacket 6 and an outer jacket 7 and is reinforced by a braid 8. The corners between the conductors and the inner jacket 6 are filled with jute fillers 4. For fixing the conductors 2 to the inner jacket 6, a fusion adhesive foil 5 is provided which is placed on the twisted assembly formed by the conductors 2 and the corner fillings 4 before the inner jacket is applied. By means of this fusion adhesive foil, a linear material-bonded connection between the insulation of the conductors 2 and the inner jacket 6 is obtained.

Figure 2:
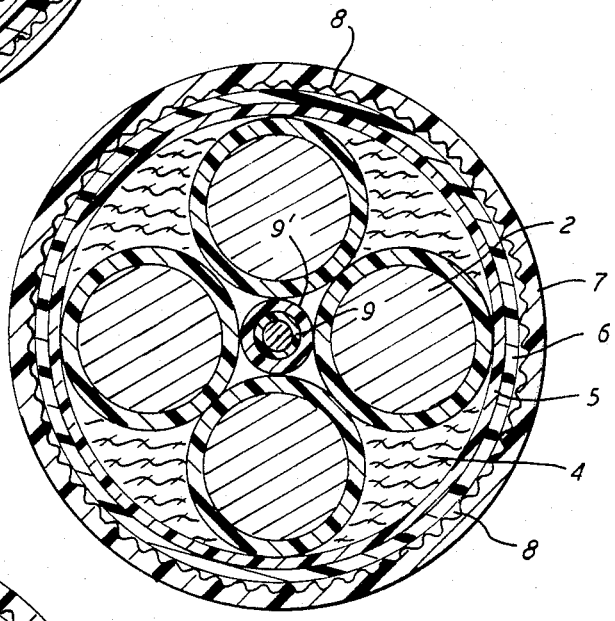
FIG. 2 is a similar view of a second embodiment of a four conductor cable according to the present invention.

In the embodiment according to FIG. 2, there is provided, differing from the embodiment according to FIG. 1, a dummy conductor 9 which consists of a relatively stiff, very strong core and a coating of a soft elastomer. This dummy conductor is additionally provided with a fusion adhesive layer 9' which consists, for instance, of a fusion adhesive foil applied as a longitudinal insert or as a wrapping. During the cross-linking or vulcanizing of the cable, the insulation of the conductors 2 are fixed linearly to the dummy conductor 9 via this fusion adhesive layer.

Figure 3:
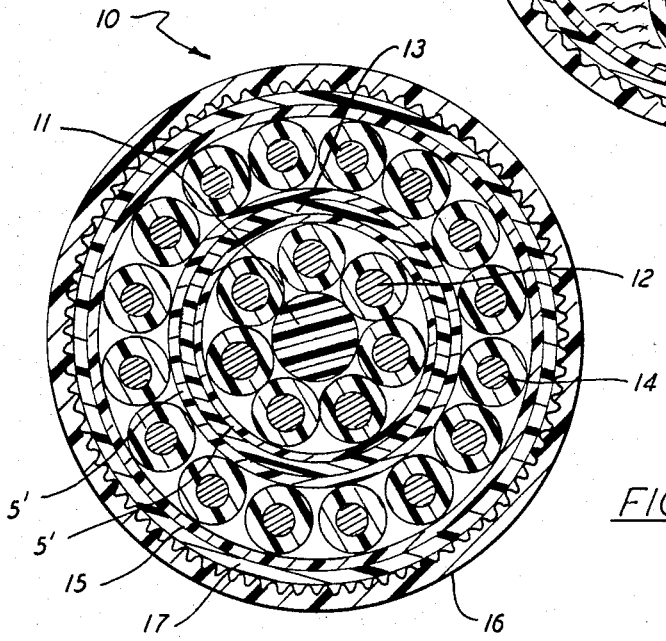
FIG. 3 is a view of a 20 conductor control cable according to the present invention.

In the embodiment according to FIG. 3, an intermediate jacket 13 is provided in a 20 conductor control cable 10 between the inner stranded layer consisting of the core 11 and the insulated conductors 12 and the outer stranding layer consisting of the insulated conductors 14; this intermediate jacket 13 is cemented to the insulation of the conductors of the inner stranding layer as well as to the insulation of the conductors of the outer stranding layer. For this purpose, fusion adhesive foils are likewise provided which are applied to the inner stranding layer 12 before the intermediate jacket 13 is applied and later to the intermediate jacket 13. The entire stranded assembly is surrounded by a jacket which consists of an inner jacket 15, an outer jacket 16 and embedded braid 17.

The embodiment according to FIG. 1 can be modified by providing each conductor 2 with a thin cover layer, about 0.1 to 0.3 mm thick, of cross-linkable polyethylene which makes a line or area wise material-bonded connection with the immediately adjacent inner jacket 6 during the vulcanization of the cable. The inner jacket in such a case consists of a vulcanized mixture with an ethylene-propylene rubber and natural rubber base, while a vulcanized polychloroprene rubber is used for the outer jacket.

What is claimed is:

1. In a flexible electric multiconductor cable, comprising a core; insulated conductors twisted about the core in one or more layers; and a plastic or rubber jacket surrounding the insulated conductors, the improvement comprising: a structural element which extends over the entire length of the cable and consists, at least in a region adjacent to the outer surface of the insulated conductors, of a rubber-elastic material with a Shore-A hardness of at most 75; and each insulated conductor having the outer surface of its insulation joined in a material-bonded manner to said structure.

2. The improvement according to claim 1 wherein said jacket comprises an inner jacket disposed adjacent said conductors and an outer jacket surrounding said inner jacket and said structural element is the inner jacket.

3. The improvement according to claim 1 wherein two conductor layers are provided with an intermediate jacket between said layers and said structural element is said intermediate jacket.

4. The improvement according to claim 1 wherein said structural element is a dummy conductor arranged in the core.

5. The improvement according to claim 1, 2, 3, or 4 wherein said structural element is a cross-linkable or vulcanizable material selected from the group consisting of ethylene-propylene rubber, natural rubber and styrene-butadiene rubber.

6. The improvement according to claim 2, wherein the conductors are connected to the inner jacket in a material-bonded manner and said inner jacket is made from a vulcanizable mixture with an ethylene-propylene rubber base mixed with natural rubber and every conductor is coated with a thin cover layer of polyethylene which is cross-linkable peroxidically, said cover layer cross-linked to said inner jacket.

7. The improvement according to claim 2 wherein said inner jacket is made from a vulcanizable mixture with an ethylene-propylene rubber base mixed with natural rubber and every conductor is coated with a thin cover layer of polyethylene which is cross-linkable peroxidically, said cover layer cross-linked to said inner jacket.

8. The improvement according to claim 1, 2, 3 or 4 wherein a fusion-adhesive foil is arranged between each conductor and the rubber-elastic structural element.

* * * * *